US008044869B2

(12) United States Patent
Overton et al.

(10) Patent No.: US 8,044,869 B2
(45) Date of Patent: Oct. 25, 2011

(54) STEALTH WIRELESS COMMUNICATIONS FACILITY

(75) Inventors: Andrew Overton, Kingsport, TN (US); Ryan Morgan, Marietta, GA (US); Keith P. Brown, Huntington Station, NY (US); David Altman, Centerport, NY (US)

(73) Assignee: The Cellboat Company, LLC, Kingsport, TN (US)

( * ) Notice: Subject to any disclaimer, the term of this patent is extended or adjusted under 35 U.S.C. 154(b) by 368 days.

(21) Appl. No.: 12/388,141

(22) Filed: Feb. 18, 2009

(65) Prior Publication Data

US 2010/0207828 A1 Aug. 19, 2010

(51) Int. Cl.
*H01Q 1/34* (2006.01)

(52) U.S. Cl. ..... 343/709; 343/710; 343/720; 343/874

(58) Field of Classification Search ..... 343/709, 343/720, 874, 710; 114/116
See application file for complete search history.

(56) References Cited

U.S. PATENT DOCUMENTS

| | | | | |
|---|---|---|---|---|
| 2,532,138 | A * | 11/1950 | Atchison | 343/730 |
| 2,623,999 | A | 12/1952 | Kulikowski | |
| 3,500,429 | A * | 3/1970 | Majkrzak | 343/883 |
| 3,745,583 | A | 7/1973 | Herbert | |
| 3,889,045 | A | 6/1975 | Logsdon | |
| 4,252,470 | A * | 2/1981 | Sluys | 405/219 |
| 5,184,145 | A | 2/1993 | Devillers et al. | |
| 5,265,551 | A * | 11/1993 | Rosenblad | 114/183 R |
| 7,000,555 | B1 | 2/2006 | Buchner | |
| 7,004,101 | B1 * | 2/2006 | Mardikian | 114/362 |
| 2004/0032372 | A1 * | 2/2004 | McKim | 343/709 |
| 2005/0003716 | A1 | 1/2005 | Takashima et al. | |
| 2005/0195123 | A1 * | 9/2005 | Caudle | 343/878 |
| 2005/0264465 | A1 * | 12/2005 | Baker | 343/846 |
| 2006/0256509 | A1 * | 11/2006 | Shilo | 361/679 |
| 2007/0125289 | A1 * | 6/2007 | Asfar et al. | 114/312 |

* cited by examiner

*Primary Examiner* — Jacob Y Choi
*Assistant Examiner* — Shawn Buchanan
(74) *Attorney, Agent, or Firm* — Tutunjian & Bitetto, P.C.

(57) ABSTRACT

A system for mounting a wireless antenna and equipment to a stealth communication tower in coastal areas and inland waterways, camouflaged as a sailboat. The Cellboat is retrofitted to securely and discreetly store wireless transceiver equipment, and an antenna is attached at the top of the mast. Access doors are disposed in the side of the Cellboat to provide access to the equipment for maintenance purposes. The Cellboat is stored at drydock, allowing for access and protection from flooding of the equipment. Alternatively, when the Cellboat is deployed in the water, the access doors will be located on the top deck of the Cellboat.

11 Claims, 8 Drawing Sheets

STEALTH WIRELESS COMMUNICATIONS FACILITY

BACKGROUND

1. Technical Field

The present invention relates to wireless communications facilities, and more particularly to techniques for mounting and camouflaging wireless communications antennas and equipment to be deployed in an appropriate setting.

2. Description of the Related Art

At the present time, it is difficult to get wireless communication coverage in coastal areas and inland waterways at or near the water, often due to difficulty in obtaining approvals for constructing wireless communication facilities. There is a need for some means by which wireless communication providers can provide access to these currently underserved areas. The available choices for mounting antennas are limited by height, topography, man-made and natural clutter, and other obstructions. The available choices for constructing wireless communications facilities at or near a waterfront are far more limited.

Currently, the available conventional wireless communication facility installations include the following: 1) rooftop installations; 2) tower structures (such as lattice, monopole, guyed and high-tension towers); and 3) water tanks. These conventional installations are not always available to wireless communications providers. The reasons a conventional site may not be suitable or available could include municipal zoning code restrictions.

A further concern regarding conventional wireless communication facilities is the possibility of damage that arises when the wireless equipment is exposed to the elements. Moreover, in a waterfront environment, sand, salt, wind and water can pose a substantial risk of corrosion, leading to the possibility of both mechanical and electrical failure. Finally, a further concern regarding conventional wireless communication facilities is the possibility that the wireless equipment could be stolen or damaged by vandals.

There is therefore a need for a product or system that provides sufficient height while being a discreet and secure housing for wireless communication antennas and equipment in an underserved area.

SUMMARY

A system for mounting wireless equipment for transmission and reception of radio frequencies comprising a hull, a mast attached to the hull, one or more wireless antennas attached to the top of the hollow mast, and one or more compartments within the hull suitable for mounting transmission and reception equipment. The system will generally sit at drydock to maintain consistency in the broadcast and reception of radio frequencies, as well as to allow for ease of access for maintenance. However, in certain instances, the Cellboat may also be deployed in the water.

One or more lockable access doors are installed in the side of the hull, providing access to the compartments. Cables run between the antennas and the equipment through the hollow mast, and are supported by a friction hoist grip. Cables also connect the equipment to electrical power and landline telephone connections on land. Alternatively, when the Cellboat is deployed in the water, the access doors will be located on the top deck of the Cellboat.

These and other features and advantages will become apparent from the following detailed description of illustrative embodiments thereof, which is to be read in connection with the accompanying drawings and incorporated herein.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Presented herein is a means by which wireless communication coverage can be provided in coastal areas and inland waterways at or near the water. A Cellboat, made according to the present principles, keeps equipment safe from damage and theft, while providing wireless communication access in previously underserved areas. The Cellboat will provide a mobile stealth solution to sitting wireless communications facilities in those areas where conventional solutions are not available, as it will not be subject to the same municipal zoning code restrictions placed on the development of conventional wireless communications facilities.

The result is that the Cellboat product provides sufficient height and stealth quality such that it is indistinguishable to passers-by and the surrounding community from a traditional sailboat.

Figure 1:
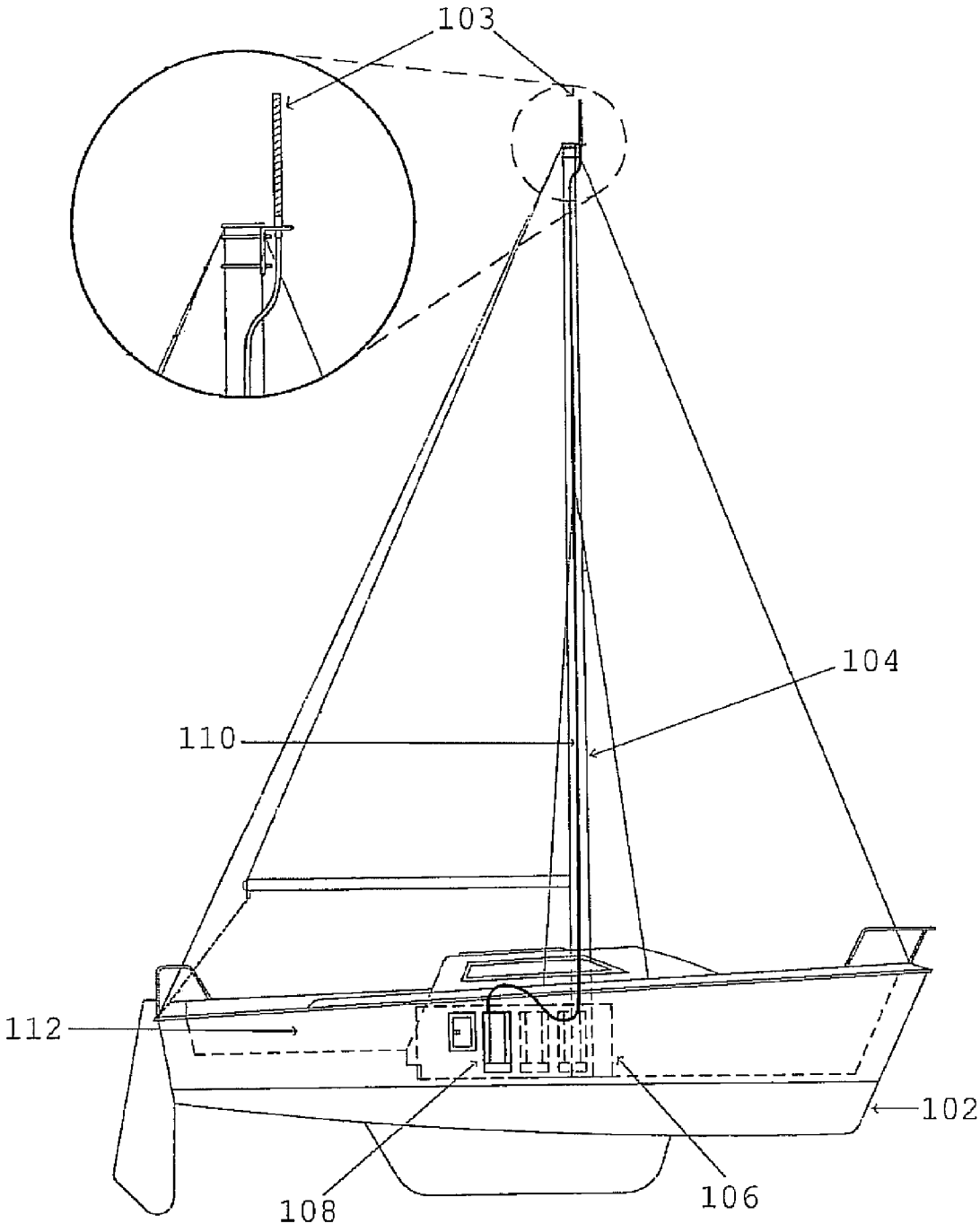
FIG. 1 depicts an illustrative embodiment of the present invention as seen from the side.
Figure 2:
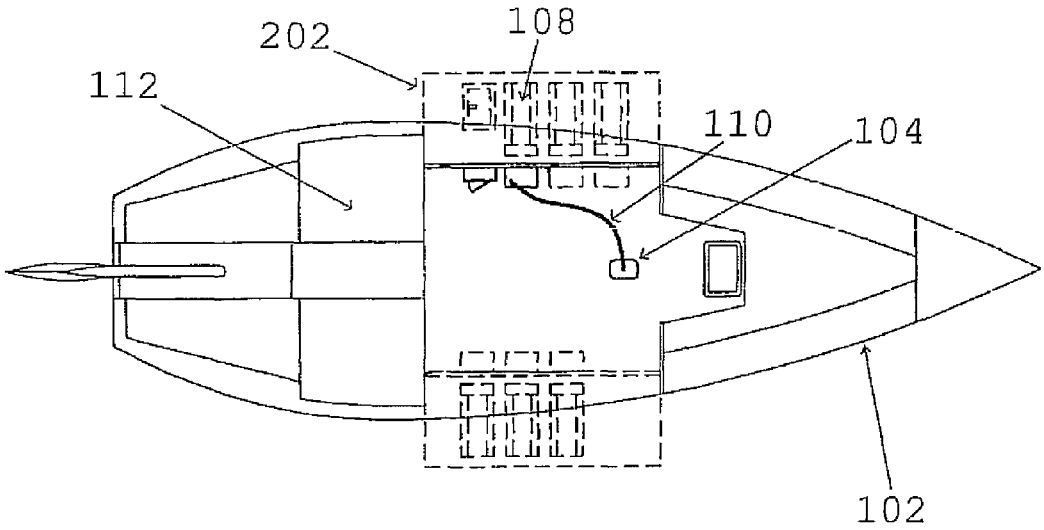
FIG. 2 depicts an illustrative embodiment of the present invention as seen from the top.

Referring now in detail to the figures in which like numerals represent the same or similar elements and initially to FIG. 1, the invention comprises a boat hull 102, to which is attached a hollow mast 104. An antenna 103 (for example, a whip antenna) is attached at the top of the mast. A compartment 106 is disposed in the hull 102. The compartment may simply open into the existing cockpit area 112 of the hull, as shown in FIG. 2 below, or it may be separately contained. Mounted in the compartment 106 is the wireless transceiver equipment 108 (for example, a base transceiver station, a telephone company 66-block, and electric circuit breakers). A cable 110 (for example, coaxial cable) is connected to the antenna 103 and to the wireless transceiver equipment 108 and is routed down through the hollow mast 104. The overall appearance of the Cellboat system should be that of a traditional sailboat. While elements relating to the Cellboat's appearance are not directly functional, they further serve the purpose of disguising the stealth qualities of the Cellboat and the true purpose of the system.

Referring to FIG. 2, an access door 202 is disposed in the side of the hull 104, providing access to the compartment 106. The wireless transceiver equipment 10B is optionally mounted directly to the access door 202. This will allow for a worker to have direct access to the equipment 108 from the ground from access door 202 for maintenance. The access door may be made weatherproof or even waterproof by using a rubber seal or gasket (not shown) around the rim of the access door, as well as optionally including active water removal devices (such as pumps).

Figure 3:
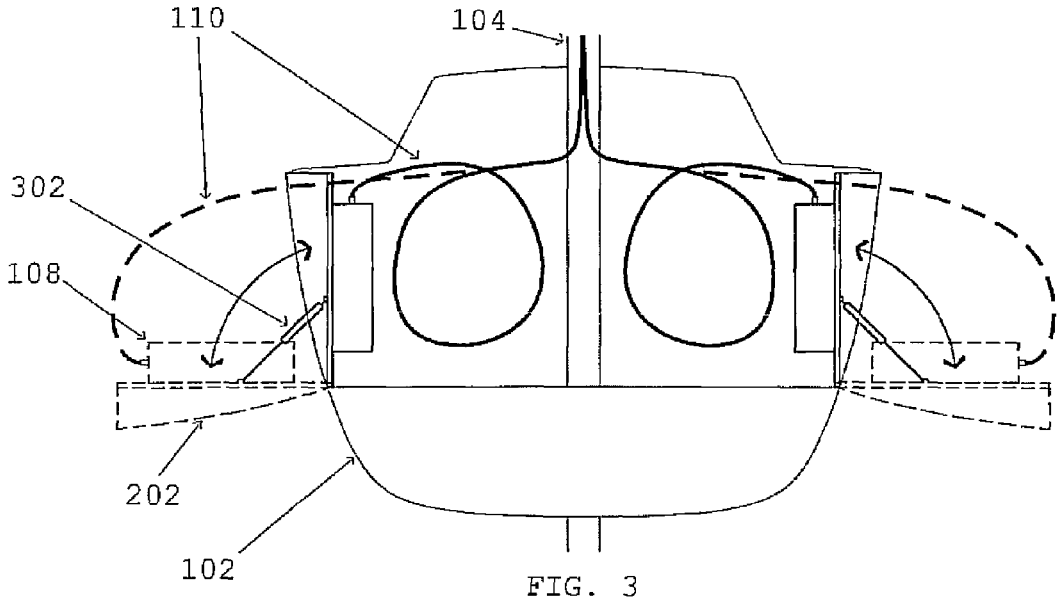
FIG. 3 depicts a cross-section of an illustrative embodiment of the present invention as seen from the front.

Referring to FIG. 3, the access door 202 is hinged at the bottom and opens out to a 90 degree angle from the hull 102. The cable 110 is looped, so as to provide additional slack for when the access door 202 is opened if the wireless transceiver equipment 108 is mounted to the access door 202. A means for suspension 302, such as a cable or a rod, holds the access door 202 parallel to the ground when it is open. The access door 202 may additionally be locked when in the upright position in order to provide additional security.

Figure 4:
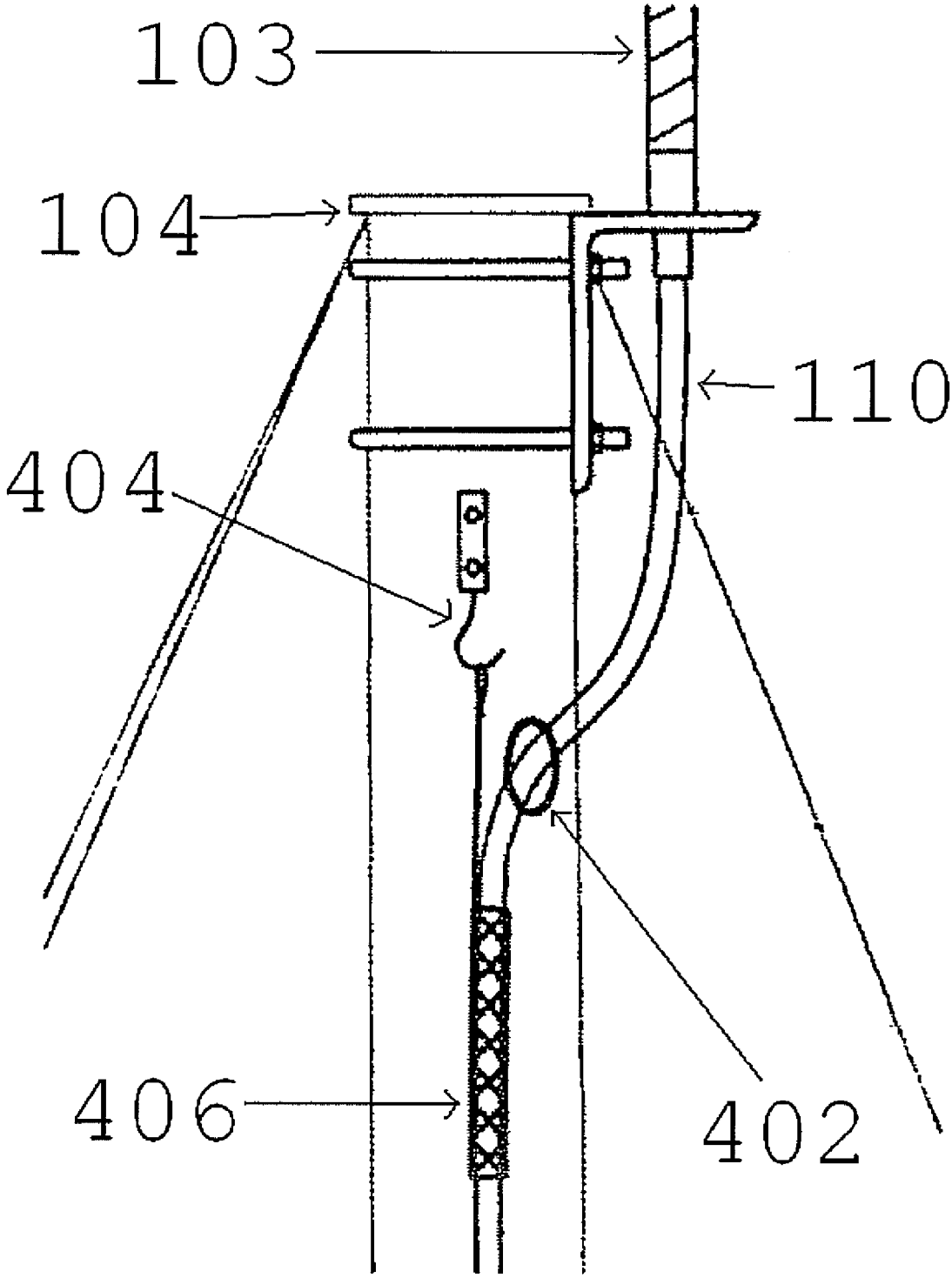
FIG. 4 depicts an illustrative embodiment of the present invention, focusing on how the wireless antenna and cables are mounted to the top of the mast.

Referring to FIG. 4, the wireless antenna 103 is mounted at the top of the mast 104. The mast 104 has a hole 402 near the top. The cable 110 is attached to the antenna 103 and enters the mast through the hole 402. A weatherproof gasket (not shown) seals the space around the cable 110 and the rim of the hole 402. This gasket is useful for preventing the accumulation of water and debris in the mast 104. In order to reduce tension on its connection to the antenna 103, the cable 110 is suspended by a friction hoist grip 406 which is hung from a hook 404. The friction hoist also prevents the cable 110 from being abraded and pinched by the hole 402. The hook 404 in turn is attached to the mast 104.

Figure 5:
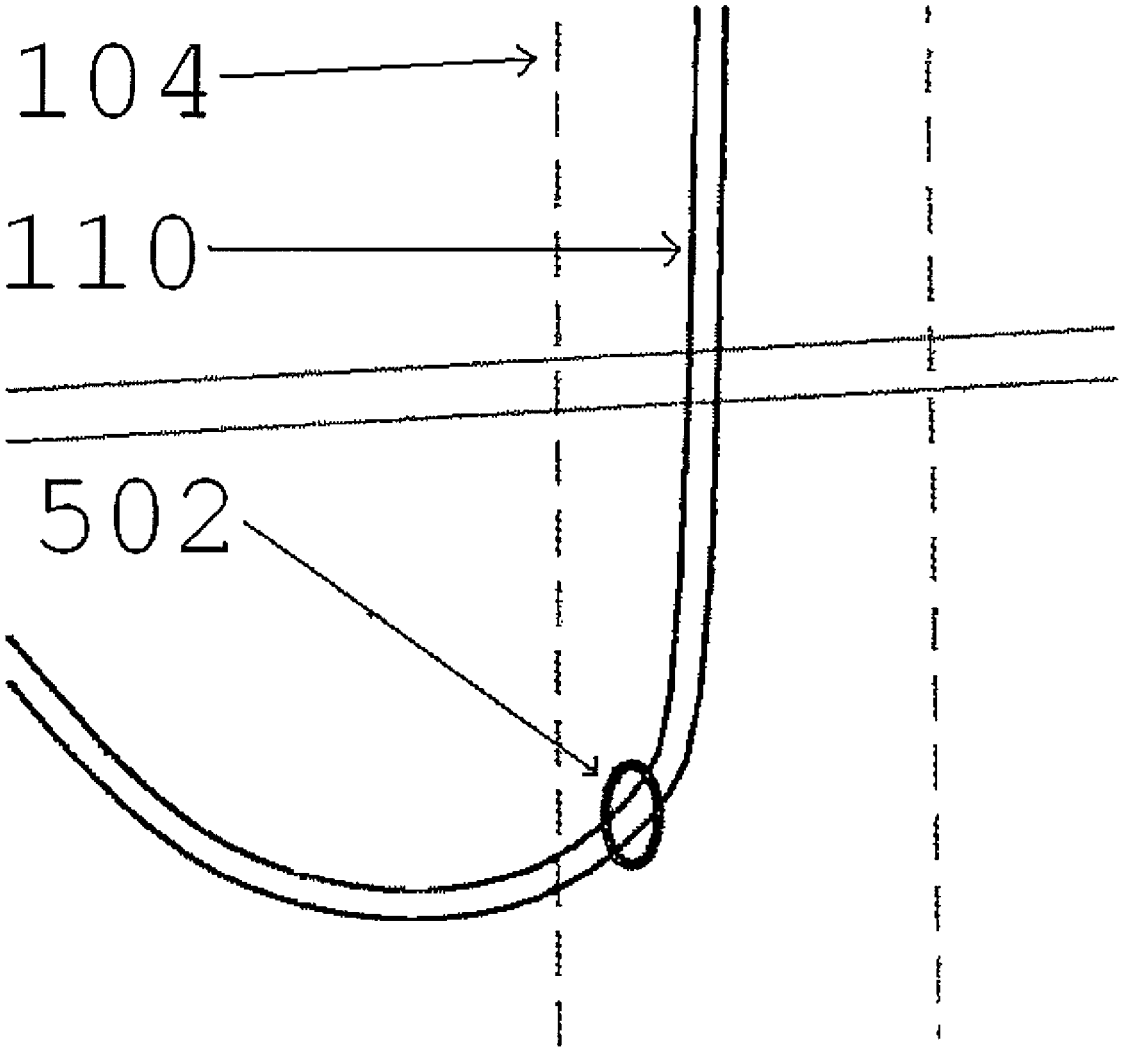
FIG. 5 depicts an illustrative embodiment of the present invention, focusing on the bottom of the mast.

Referring to FIG. 5, the mast 104 has a hole 502 at the bottom, and the cable 110 exits the mast through hole 502. A weatherproof gasket (not shown) seals the space between the cable 110 and the rim of the hole 502. As in FIG. 4, this gasket is useful for preventing the accumulation of water and detritus in the mast 104.

Figure 6:
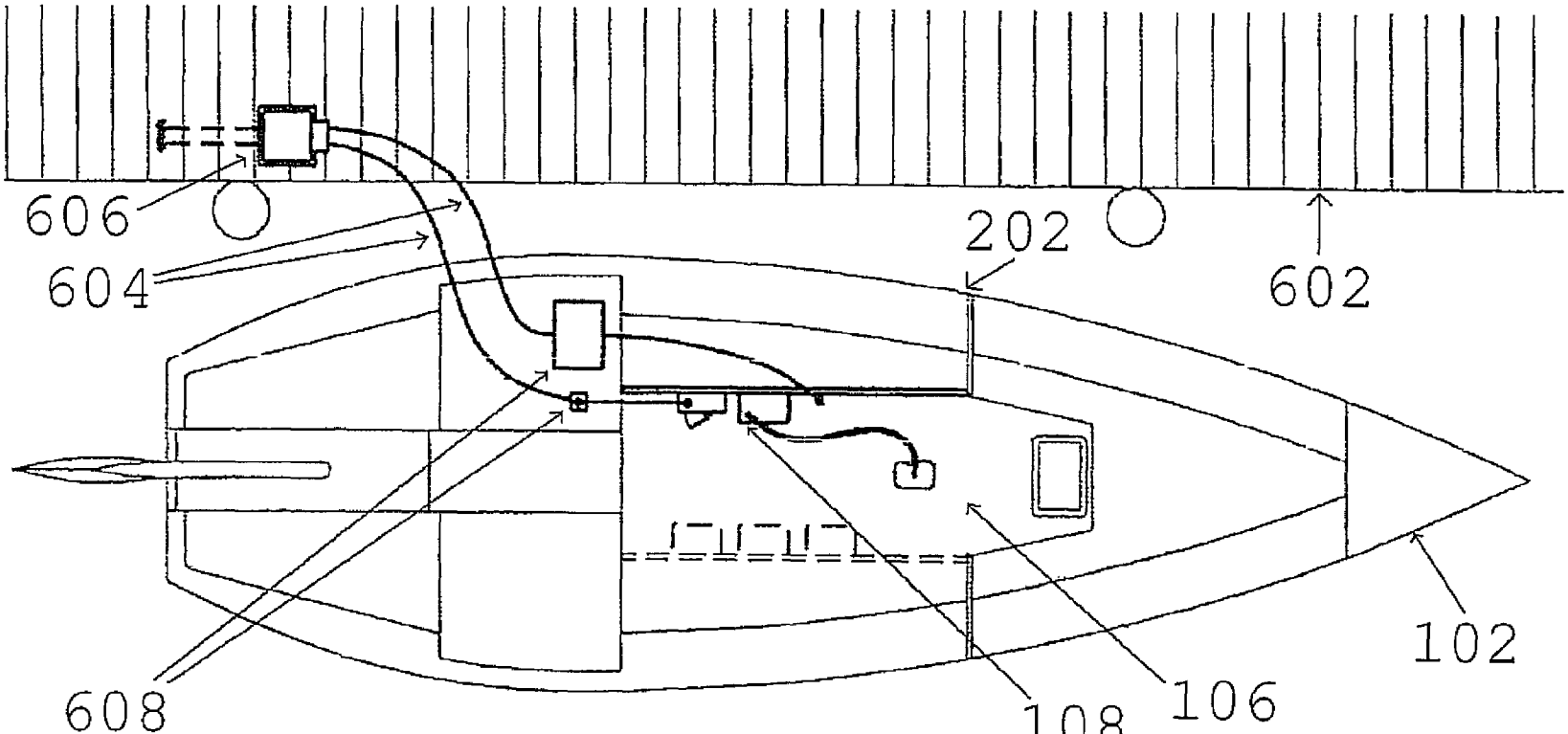
FIG. 6 depicts an illustrative embodiment of the present invention as seen from the top.

Referring to FIG. 6, the hull 102 may be stored at a dock 602, either in the water or in drydock. Being stationed in drydock allows for access to the access door 202, and keeps the compartment 106 from taking on water, while being in the water makes the system less accessible and more convincing in its disguise. Being at a dock (whether dry or wet) provides easy access to electric power and telephone company connections. Cables 604 connect the wireless transceiver equipment to a weatherproof electric/telephone service connection point 606 on the dock 602, which provides the equipment with electric power and a connection to the telephone company. The cables 604 enter the hull 102 by way of weatherproof connection points 608 on top of the hull 102.

Figure 7:
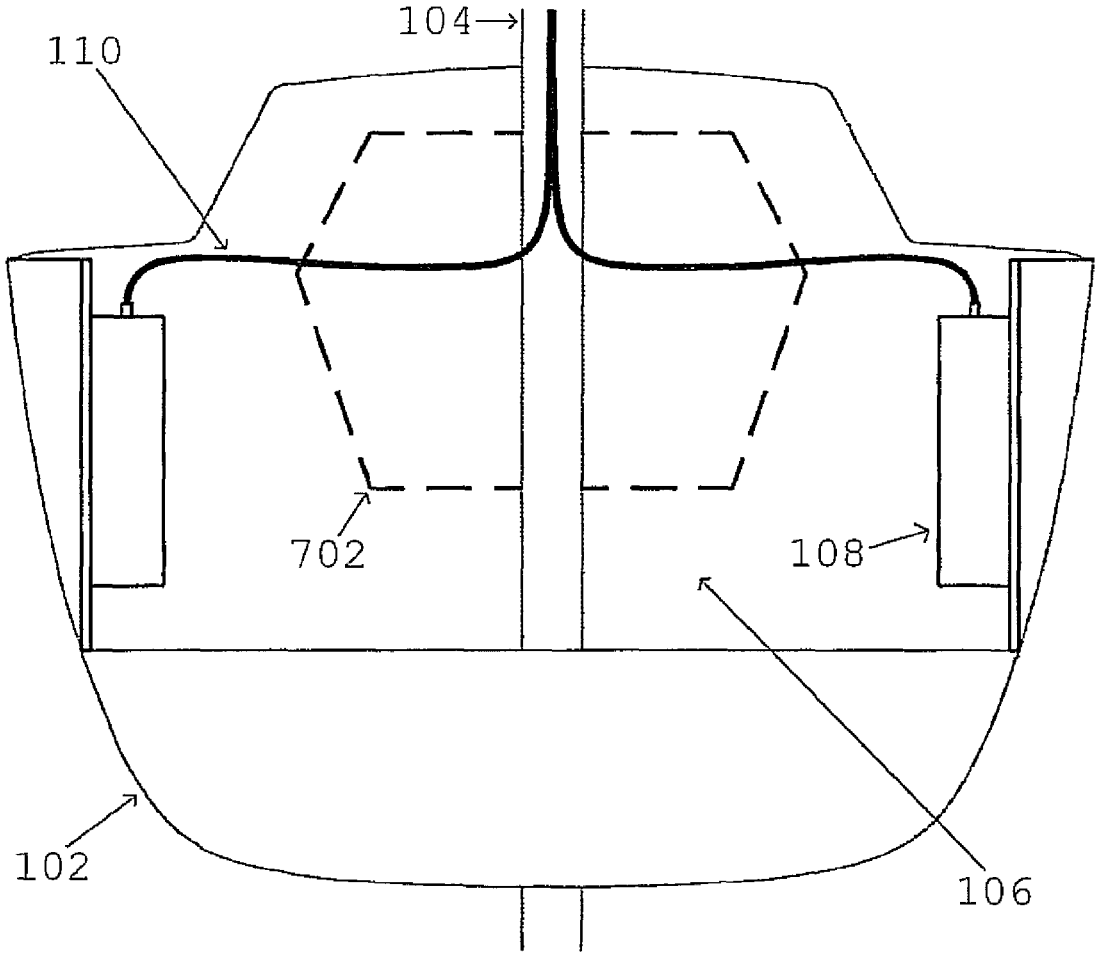
FIG. 7 depicts an alternative embodiment of the present invention as seen from the front.

Referring to FIG. 7, an alternative embodiment is shown where an access door 702 is disposed between the cockpit area and the compartment 106. In this embodiment, the wireless transceiver equipment 108 is mounted to the hull 102. In addition, the cable 110 need not be looped before ascending mast 104, as the wireless transceiver equipment is no longer mounted to an access door.

Figure 8:
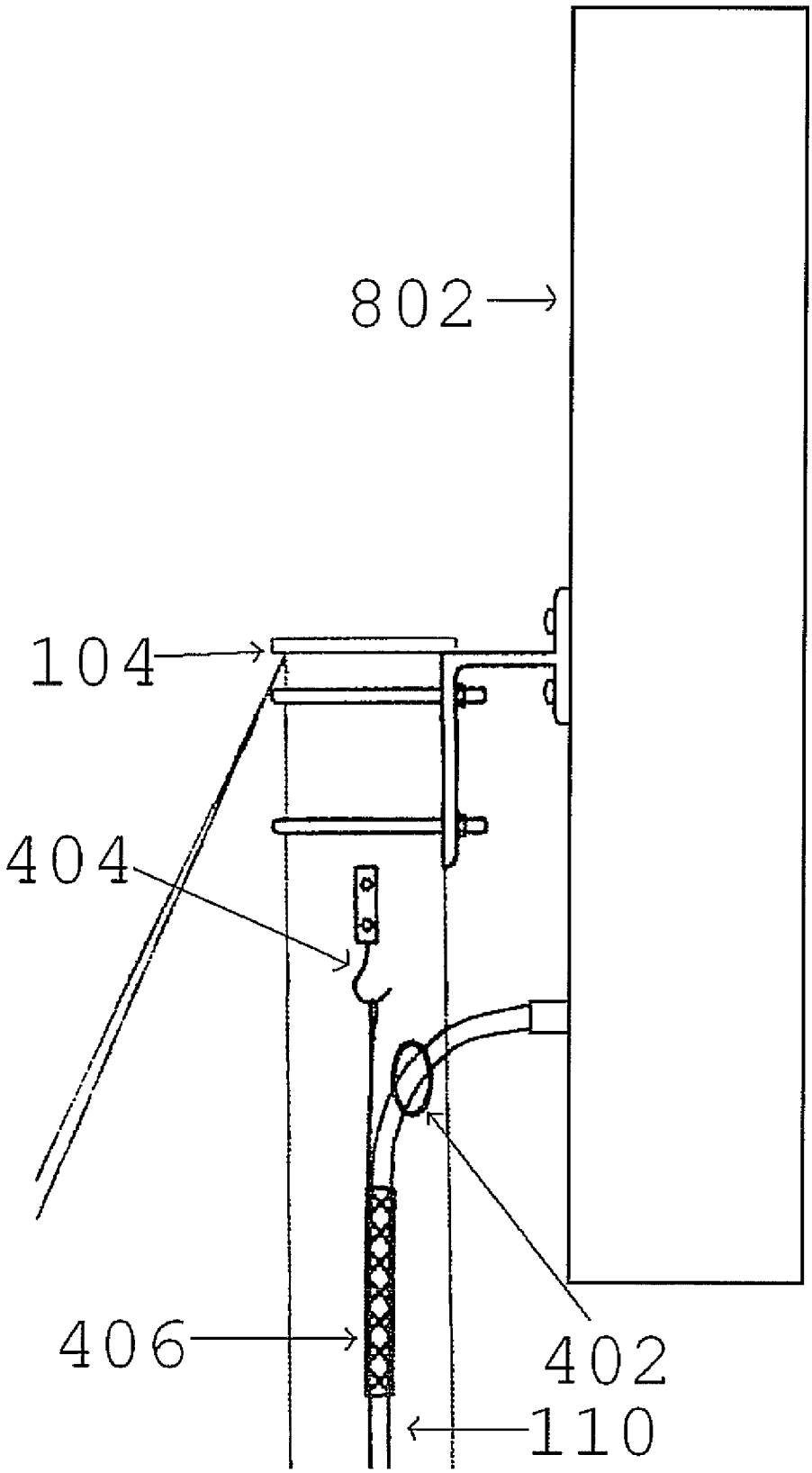
FIG. 8 depicts an alternative embodiment of the present invention, showing an alternative antenna.

Referring to FIG. 8, an alternative embodiment is shown where a panel antenna 802 is used instead of a whip antenna. The cable 110 attaches to the back of the antenna 802, using the same hole 402 and hoist grip 406 described above.

Figure 9:
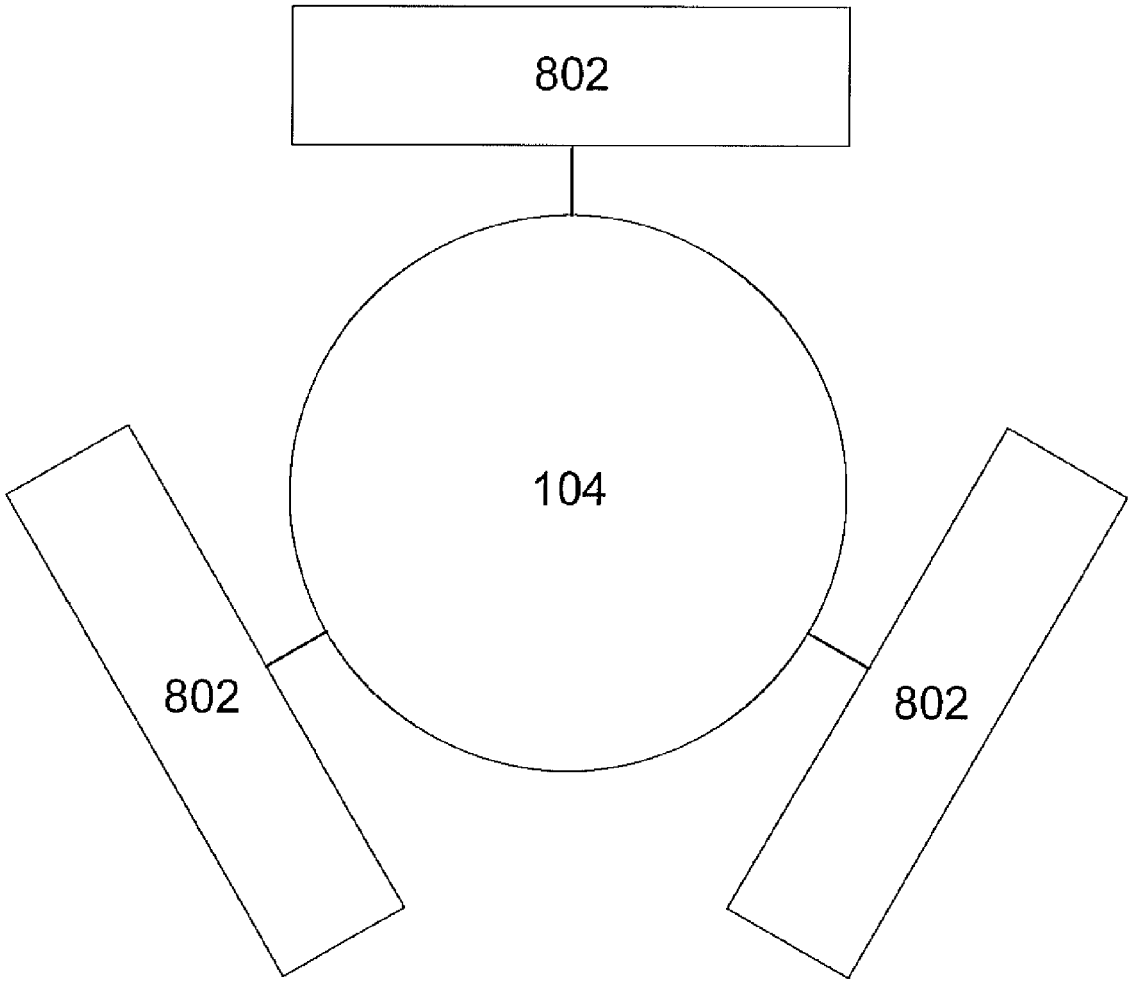
FIG. 9 depicts an alternative embodiment of the present invention, showing an alternative antenna arrangement as seen from the top.

Referring to FIG. 9, an alternative embodiment is shown using a plurality of panel antennas 802. By arranging panels around the mast 104, the advantages of a panel antenna may be combined with the 360° coverage of a whip antenna. FIG. 9 depicts three panel antennas, with an angular displacement of 120°, but other arrangements and numbers of panels are contemplated.

It is contemplated that the present invention may be created by retrofitting an existing boat, or by assembling it so as to exclude unnecessary components. An embodiment of the invention is designed to stay in permanent drydock, facilitating access for maintenance and lowering the cost of waterproofing. However, it is also contemplated that the system may be made sufficiently waterproof such that the system may float in the water near a dock.

Having described preferred embodiments of a system and method (which are intended to be illustrative and not limiting), it is noted that modifications and variations can be made by persons skilled in the art in light of the above teachings. It is therefore to be understood that changes may be made in the particular embodiments disclosed which are within the scope and spirit of the invention as outlined by the appended claims. Having thus described aspects of the invention, with the details and particularity required by the patent laws, what is claimed and desired protected by Letters Patent is set forth in the appended claims.

What is claimed is:

1. A system for mounting equipment for wireless transmission and reception comprising:

a decoy hull configured for dry-dock storage;

a mast attached to the decoy hull;

one or more antennas for wireless transmission and reception attached to the top of the mast;

one or more compartments within the decoy hull configured for mounting transmission and reception equipment;

one or more weatherproof access doors disposed at a bottom of a side surface of the decoy hull at least partially below a water line of the decoy hull to give access to the compartments from the outside of the hull.

2. The system according to claim 1, wherein at least one of the one or more access doors are disposed on a top surface of the hull.

3. The system according to claim 1, wherein the system further comprises transmission and reception equipment mounted on the inside of at least one of the one or more access doors.

4. The system according to claim 1, wherein the system further comprises a means for suspending the access doors parallel to the ground when open.

5. The system according to claim 1, wherein the mast is hollow and one or more cables connected to the antennas runs inside the hollow mast to the compartments.

6. The system according to claim 5, further comprising a friction hoist grip that is attached to the mast and which supports the cables.

7. The system according to claim 5, further comprising holes at the top and bottom of the mast, wherein the holes are sealed with weatherproof gaskets.

8. The system according to claim 1, wherein the system further comprises wireless communication transmission and reception equipment mounted in the compartments.

9. The system according to claim 8, wherein the system further comprises cables connecting the wireless equipment to power and to telephone company lines.

10. The system according to claim 1, wherein the antennas are whip antennas.

11. The system according to claim 1, wherein the antennas are panel antennas.

* * * * *